US005465024A

United States Patent [19]

Kane

[11] Patent Number: 5,465,024

[45] Date of Patent: Nov. 7, 1995

[54] FLAT PANEL DISPLAY USING FIELD EMISSION DEVICES

[75] Inventor: Robert C. Kane, Woodstock, Ill.

[73] Assignee: Motorola, Inc., Schaumburg, Ill.

[21] Appl. No.: 839,717

[22] Filed: Feb. 24, 1992

Related U.S. Application Data

[63] Continuation of Ser. No. 414,836, Sep. 29, 1989, abandoned.

[51] Int. Cl.[6] ..... H01J 19/24

[52] U.S. Cl. ..... 313/309; 313/422; 313/495; 313/351

[58] Field of Search ..... 313/309, 336, 313/351, 422, 495; 315/169.3; 340/781, 783

[56] References Cited

U.S. PATENT DOCUMENTS

| | | | |
|---|---|---|---|
| 3,755,704 | 8/1973 | Spindt et al. | 313/309 |
| 3,789,471 | 2/1974 | Spindt et al. | 29/25.17 |
| 3,812,559 | 5/1974 | Spindt et al. | 29/25.18 |
| 3,855,499 | 12/1974 | Yamada et al. | 313/336 |
| 3,894,332 | 7/1975 | Nathanson et al. | 29/578 |
| 3,921,022 | 11/1975 | Levine | 313/309 |
| 3,998,678 | 12/1976 | Fukase et al. | 156/3 |
| 4,008,412 | 2/1977 | Yuito et al. | 313/309 |
| 4,178,531 | 12/1979 | Alig | 313/409 |
| 4,307,507 | 12/1981 | Gray et al. | 29/580 |
| 4,513,308 | 4/1985 | Greene et al. | 357/55 |
| 4,578,614 | 3/1986 | Gray et al. | 313/309 |
| 4,685,996 | 8/1987 | Busta et al. | 156/628 |
| 4,721,885 | 1/1988 | Brodie | 313/576 |
| 4,729,851 | 3/1988 | Lambe | 313/309 |
| 4,827,177 | 5/1989 | Lee et al. | 313/306 |
| 4,874,981 | 10/1989 | Spindt | 313/309 |
| 4,884,018 | 11/1989 | Biberian | 313/422 |
| 4,885,448 | 12/1989 | Kasner et al. | 219/121.69 |
| 4,904,895 | 2/1990 | Tsukamoto et al. | 313/336 |
| 4,947,160 | 8/1990 | Leksell et al. | 340/805 |
| 4,956,574 | 9/1990 | Kane | 313/336 |
| 4,970,887 | 7/1976 | Smith et al. | 313/309 |

FOREIGN PATENT DOCUMENTS

| | | |
|---|---|---|
| 0172089 | 7/1985 | European Pat. Off. . |
| 2604823 | 10/1986 | France . |
| 855782 | 2/1982 | U.S.S.R. . |
| 2204991A | 11/1988 | United Kingdom . |

OTHER PUBLICATIONS

A Vacuum Field Effect Transistor Using Silicon Field Emitter Arrays, by Gray, 1986 IEDM, pp. 776–779.

Advanced Technology; flat cold–cathode CRTs, by Ivor Brodie, Information Display, Jan. 1989, pp. 17–19.

Field–Emitter Arrays Applied to Vacuum Flourescent Display, by Spindt et al., Jan., 1989 issue of IEEE Transactions on Electronics Devices, pp. 226–228.

Field Emission Cathode Array Development for High–Current Density Applications by Spindt et al., dated Aug., 1982, vol. 16 of Applications of Surface Science, pp. 268–276.

*Primary Examiner*—Michael Horabik

*Attorney, Agent, or Firm*—Eugene A. Parsons

[57] ABSTRACT

A flat screen display constructed through use of cold cathode field emission devices, wherein the devices serve to support the structural integrity of the resultant assembly, and wherein edge emission is utilized to energize luminescent material in support of the display function.

7 Claims, 2 Drawing Sheets

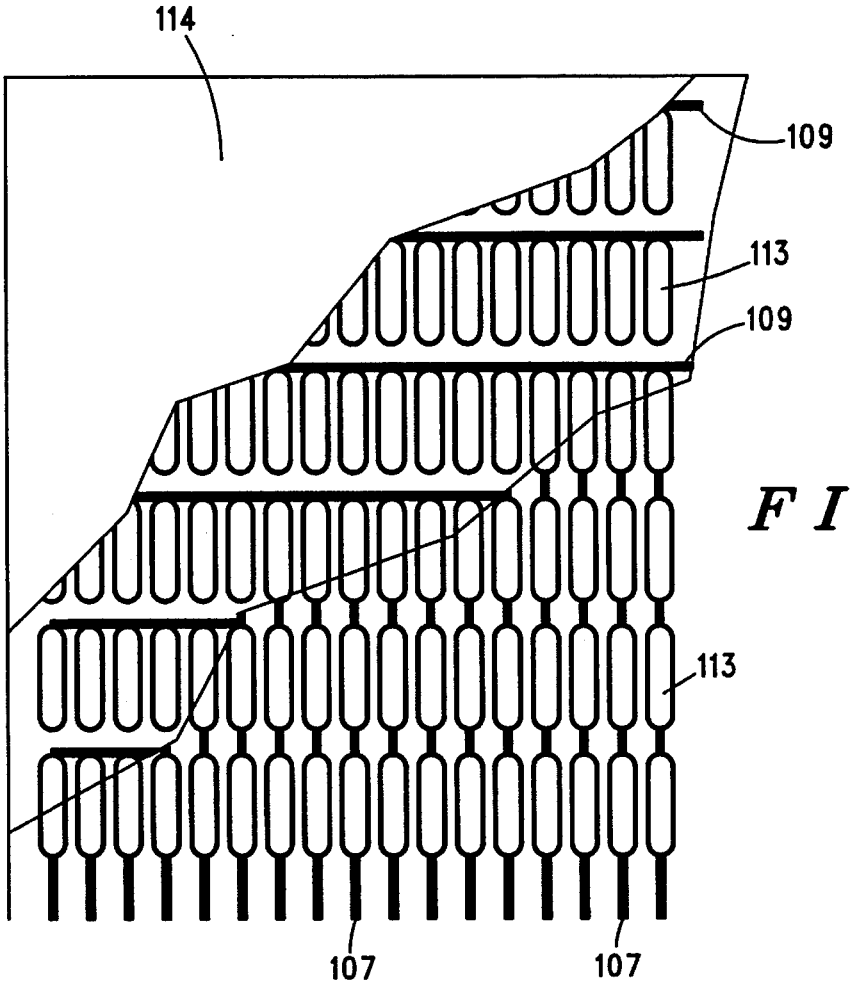
FIG. 9
FIG. 10
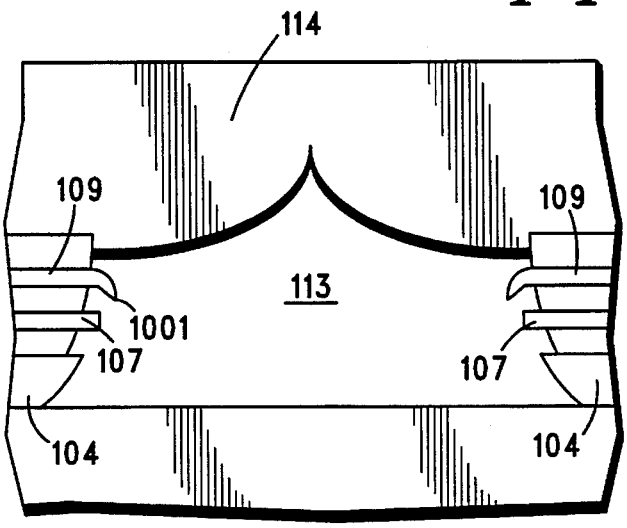

FLAT PANEL DISPLAY USING FIELD EMISSION DEVICES

This application is a continuation of prior application Ser. No. 07/414,836, filed Sep. 29,1989 now abandoned.

TECHNICAL FIELD

This invention relates generally to flat panel displays and to cold cathode field emission devices.

BACKGROUND OF THE INVENTION

Flat panel displays are known in the art. Such displays, often comprised of LCD, LED, or electroluminescent elements, provide a multiple pixel platform to allow the display of graphic and alphanumeric information. Flat panel displays are preferable in many applications where the display screen apparatus volume is a prime consideration. Such displays are quite costly, however, when compared to non-flat screen display technologies, particularly as the size of the screen increases.

The use of cold cathode field emission devices has been proposed for use in implementing a flat screen display. To date, however, the manufacturability of cold cathode field emission devices in a form suitable for use with a flat screen display has not supported this desired application. In particular, prior art cold cathode devices are either unsuitable for use in a flat screen display, or require the provision of difficult-to-manufacture cathode structures. A need therefore exists for a cold cathode field emission device that is both readily manufacturable and suitable for use in a flat screen display.

BRIEF DESCRIPTION OF THE DRAWINGS

FIG. 9 comprises a top plan partially section view of a plurality of devices constructed in accordance with the invention; and FIG. 10 comprises a side elevational detail view of an alternative embodiment constructed in accordance with the invention.

BEST MODE FOR CARRYING OUT THE INVENTION

Figure 1:
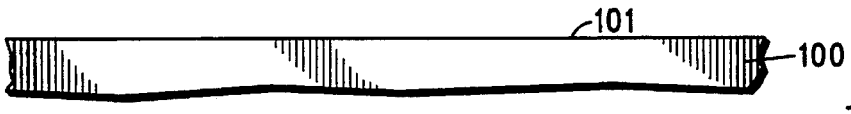
FIG. 1 comprises a side elevational detail view of a first step in manufacturing a device in accordance with the invention.

A transparent (or translucent, depending upon the application) glass plate (100) (FIG. 1) provides a device support substrate on one surface (101) thereof, and also serves as the screen for the display itself. Preferably, the support surface (101) will have disposed thereon an appropriate luminescent material, such as phosphor.

Figure 2:
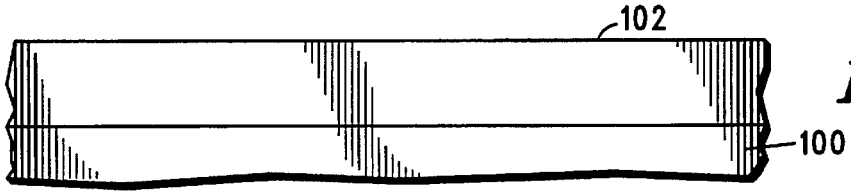
FIG. 2 comprises a side elevational detail view of a second step in manufacturing a device in accordance with the invention.
Figure 3:
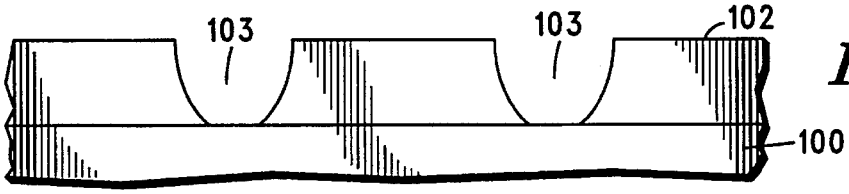
FIG. 3 comprises a side elevational detail view of a third step in manufacturing a device in accordance with the invention.

An appropriate insulating material, such as polyimide (102) (FIG. 2) is deposited on the glass (100). A suitable masked etching process forms a plurality of cavities (103) (FIG. 3) in the insulating material (102). Preferably, these cavities (103) extend sufficiently deep within the insulating material (102) to cause exposure of the glass (100) or phosphor coated thereon. In an appropriate embodiment, however, this may not necessarily be required.

Figure 4:
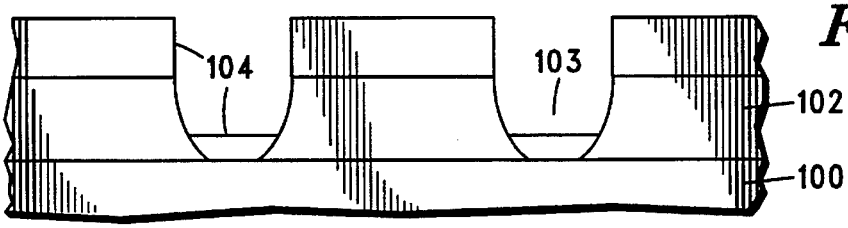
FIG. 4 comprises a side elevational detail view of a fourth step in manufacturing a device in accordance with the invention.
Figure 5:
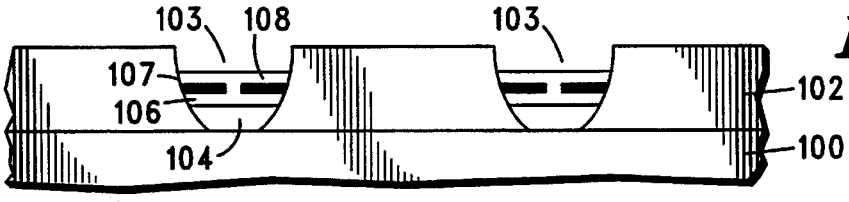
FIG. 5 comprises a side elevational detail view of a fifth step in manufacturing a device in accordance with the invention.

A metallized layer (104) (FIG. 4) is then deposited, resulting in a conductive layer on both the upper surface of the insulating material (102) and within the cavity (103). Using an appropriate strip resist process, the metallization layer on the upper surface of the insulator (102) can then be removed (as depicted generally in FIG. 5). A first oxide layer (106) can then be grown over the assembly, followed by a metal deposition layer (107) and a second oxide growth layer (108). A strip resist process can then again be utilized to remove the latter layers from the upper surface of the insulating material (102). This will result in leaving the various layers described as occupying the volumes within the oval-shaped cavities (103) only (see FIG. 9).

Figure 6:
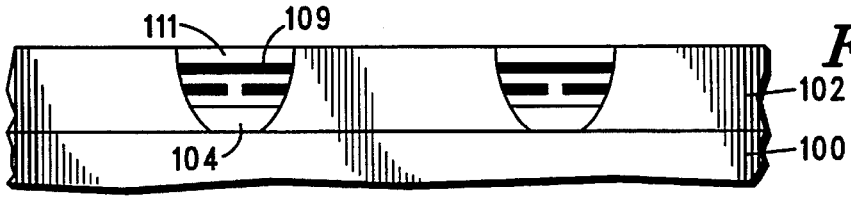
FIG. 6 comprises a side elevational detail view of a sixth step in manufacturing a device in accordance with the invention.

Next, a third metallization layer (109) (FIG. 6) is deposited over the assembly, followed by additional oxide growths (111). Following this, a strip resist step removes the latter layers from the surface of the insulating layer (102). This will leave a plurality of oval shaped conductors (109) (as viewed from above; see FIG. 9) that may be coupled together in groups by a conductive strip. This will allow appropriate electrical potential to be applied thereto during use of the finished device.

Figure 7:
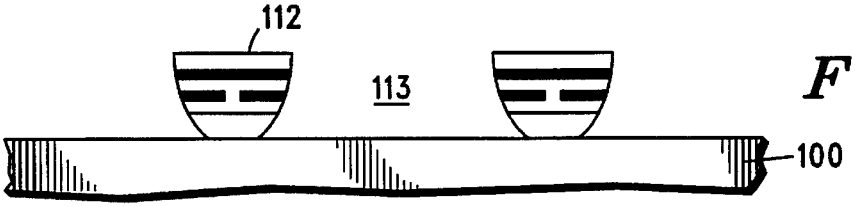
FIG. 7 comprises a side elevational detail view of a seventh step in manufacturing a device in accordance with the invention.

Next, an appropriate etching process that selectively etches the insulating material (102) (FIG. 7) removes the initial insulating material (102) from the assembly, leaving only the metallization layers and oxide growth structure (which serves as a cold cathode field emission device (112) as described below) and a plurality of spaces (113) as shown in FIGS. 7 and 9 and 11.

Figure 8:
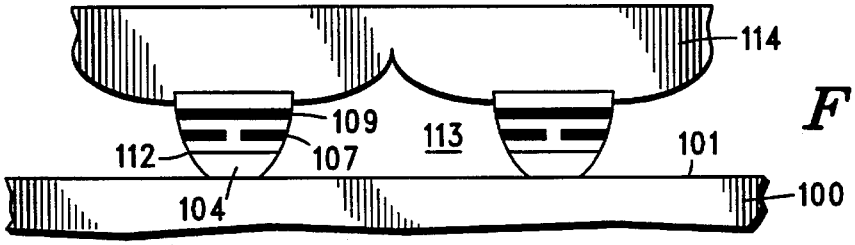
FIG. 8 comprises a side elevational detail view of an eighth step in manufacturing a device in accordance with the invention.

Lastly, a low angle vapor phase deposition process provides an insulating encapsulating layer (114) over the entire assembly, as depicted in FIG. 8 and FIG. 11. Preferably, this step will occur in a vacuum, such that the resulting cavities (113) will contain a vacuum. It is appropriate to note that the field emitter structure provides a support function in favor of the structural integrity of the combined apparatus, and in opposition to the tendency of the vacuum to cause the glass layer (100) and the final deposition layer (114) to be urged towards one another by atmospheric pressure.

So configured, the first metallization layer (104) will serve as an anode for the resulting field emission device. The second metallization layer (107) will serve as the gate for the field emission device. Finally, the third metallization layer (109) functions as a cold cathode for the resulting field emission device.

In particular, when the resultant devices (112) are formed having a length, the third metallization layer (109) will present an edge that will support edge mode field emission activity. Electrons emitted from this edge will make their way to the anode (104). Some of these electrons, however, will strike the glass surface (101), and hence will energize the luminescent material deposited thereon, causing the luminescent material to illuminate. This illumination can be discerned from the opposite side of the glass.

In the alternative, referring to FIG. 10 when forming the third conductive layer (109) and its supporting oxide growths, a facet can be formed in the oxide growth using well known techniques, to allow subsequent formation of a third conductive layer (109) having a more pronounced geometric discontinuity (1001). Depending upon the application, this geometric discontinuity (1001) may provide enhanced field emission activity in comparison to the first embodiment described, though again emission will occur in an edge mode fashion.

By appropriate disposition of the above described structure, these areas of controllable illumination can function as pixels, or groups of these illumination spots can be collected together to represent a single display pixel. Which pixels are illuminated, and to some extent the degree of illumination, can be influenced through appropriate control of the potential of the gate (layer 107) with respect to the potential between the cathode (layer 109) and the anode (layer 104).

In this way, selected portions of the luminescent material disposed on the glass (100) can be selectively energized through appropriate control of the electrons as emitted from the edge emitters of the field emission devices (112) provided.

These devices (112) can be readily manufactured using known manufacturing techniques, and do not require the provision of non-planar cathodes that are difficult to manufacture.

What is claimed is:

1. A flat panel display comprising:

a field emission device including an edge emitter and a gate spaced from the edge emitter, the gate and edge emitter being constructed to have a potential applied therebetween to produce edge emission of electrons;

a screen including a layer of luminescent material positioned in spaced relation from the edge emitter and the gate of the field emission device to receive at least some emitted electrons and thereby energize a part of the luminescent material; and an encapsulating layer, wherein the edge emitter is a part of a support structure that is positioned between the screen and the encapsulating layer.

2. The flat panel display of claim 1 wherein the support structure contacts both the screen and the encapsulating layer.

3. The flat panel display of claim 2, wherein at least one area between the screen and the encapsulating layer has a vacuum formed therein.

4. The flat panel display of claim 3, wherein the support structure contributes, at least in part, to maintaining a distance between the screen and the encapsulating layer.

5. A flat panel display comprising:

a substrate having a surface;

a screen including a layer of luminescent material deposited on the surface of the substrate; and a plurality of field emission devices each including a gate supported on the substrate and spaced from the screen and an edge emitter supported on the gate and spaced from the gate, the screen, gate and edge emitter defining a cavity, and the gate and edge emitter being constructed to have a potential applied therebetween to produce edge emission of electrons into the cavity and generally towards the screen so as to receive at least some emitted electrons at the screen and thereby energize a part of the luminescent material.

6. A flat panel display as claimed in claim 5 including in addition an encapsulating layer deposited over and supported by the plurality of field emission devices to enclose the cavity defined in each of the plurality of field emission devices.

7. A flat panel display comprising:

a plurality of field emission devices each including an edge emitter and a gate, the gate and edge emitter being constructed to have a potential applied therebetween to produce edge emission of electrons; and a screen including a layer of luminescent material positioned in spaced relation from the edge emitter and the gate of each of the plurality of field emission devices to receive at least some emitted electrons and thereby energize a part of the luminescent material;

the gate, edge emitter and screen being formed to define a cavity having a generally oval cross section into which the edge emitter emits electrons with the screen forming a first surface of the cavity, the edge emitter being positioned adjacent a second surface spaced from the first surface and the edge emitter being positioned therebetween.

* * * * *